United States Patent [19]

Teren

[11] 4,412,535

[45] Nov. 1, 1983

[54] REMOTELY CONTROLLED MASSAGING APPARATUS

[76] Inventor: Dorothy R. Teren, 7795 N. Pines View Dr., Scottsdale, Ariz. 85258

[21] Appl. No.: 293,135

[22] Filed: Aug. 17, 1981

[51] Int. Cl.[3] ..... A61H 15/00

[52] U.S. Cl. ..... 128/57; 46/254

[58] Field of Search ..... 128/56, 57, 62 R, 52, 128/32; 46/254, 262

[56] References Cited

U.S. PATENT DOCUMENTS

| | | | |
|---|---|---|---|
| D. 185,246 | 5/1959 | Taran | 128/57 |
| 687,363 | 11/1901 | Wirt | 128/62 R |
| 2,621,652 | 12/1952 | Ehrhardt | 128/57 |
| 2,628,611 | 2/1953 | Wagner | 128/57 |
| 2,944,543 | 7/1960 | Newcombe | 128/32 |
| 3,029,371 | 4/1962 | Saito | 46/254 X |
| 3,077,878 | 2/1963 | Baulard | 128/57 |
| 3,078,843 | 2/1963 | Brisson | 128/52 |
| 3,385,290 | 5/1968 | Schmidt | 128/57 |
| 3,752,246 | 8/1973 | Sullivan | 46/254 X |
| 3,850,163 | 11/1974 | Andis, Sr. | 128/57 |
| 3,970,078 | 7/1976 | Rogers, Jr. | 128/57 |
| 4,041,938 | 8/1977 | Wintoniw | 128/52 |
| 4,157,712 | 6/1979 | Gaynor | 128/57 |
| 4,168,468 | 9/1979 | Mabuchi et al. | 46/254 X |
| 4,299,301 | 6/1981 | Janin | 46/254 X |

FOREIGN PATENT DOCUMENTS

| | | | |
|---|---|---|---|
| 177513 | 2/1954 | Fed. Rep. of Germany | 128/57 |
| 1093828 | 11/1954 | France | 128/57 |
| 1581242 | 12/1980 | United Kingdom | 46/254 |

*Primary Examiner*—Richard J. Apley
*Assistant Examiner*—David J. Brown
*Attorney, Agent, or Firm*—Cahill, Sutton & Thomas

[57] ABSTRACT

A self-propelled vehicular unit of a size sufficiently small to be transported across a body surface area to be massaged includes drive means for propelling the unit while imparting a massaging action to the area traversed and steering elements for steering the unit. A radio control receiver within the unit is responsive to a remotely located transmitter to generate signals which signals are translated through servo mechanism to control the speed and direction of movement of the unit. An element may be attached to the unit to provide a scratching action across the traversed area. The force of either or both the massaging and scratching actions may be varied by altering the weight of the unit.

6 Claims, 7 Drawing Figures

FIG. 1
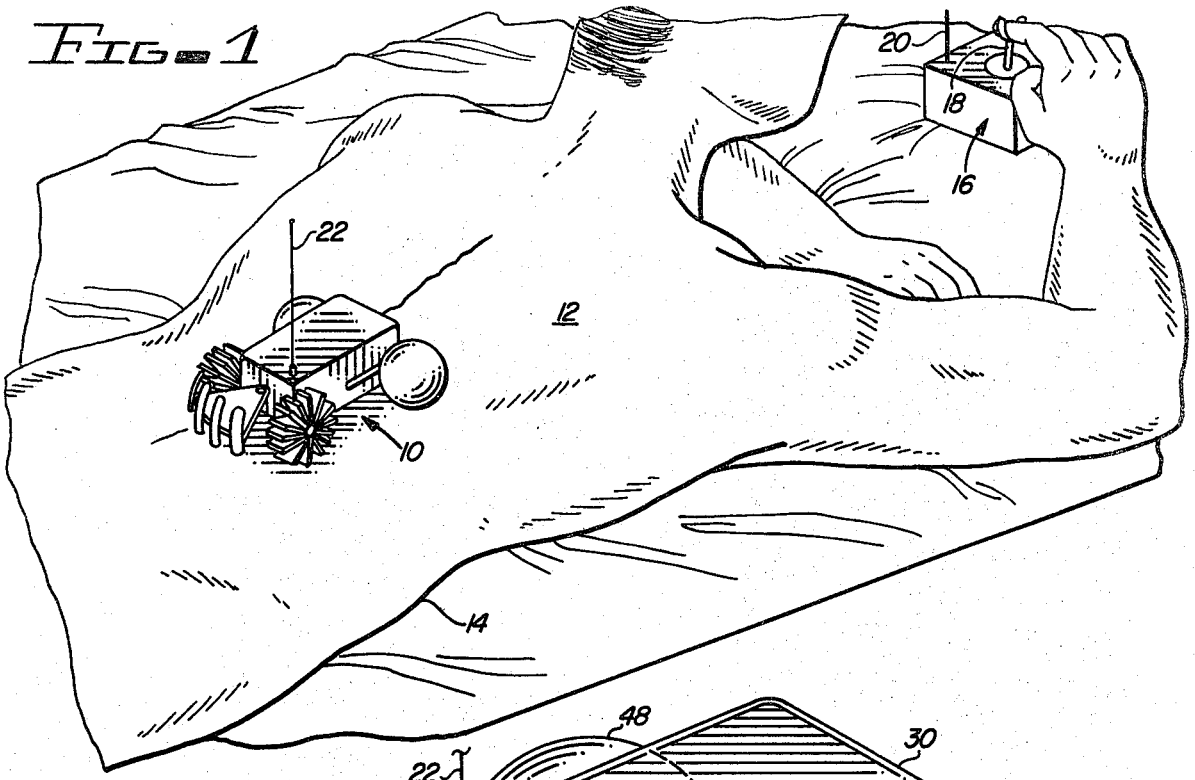
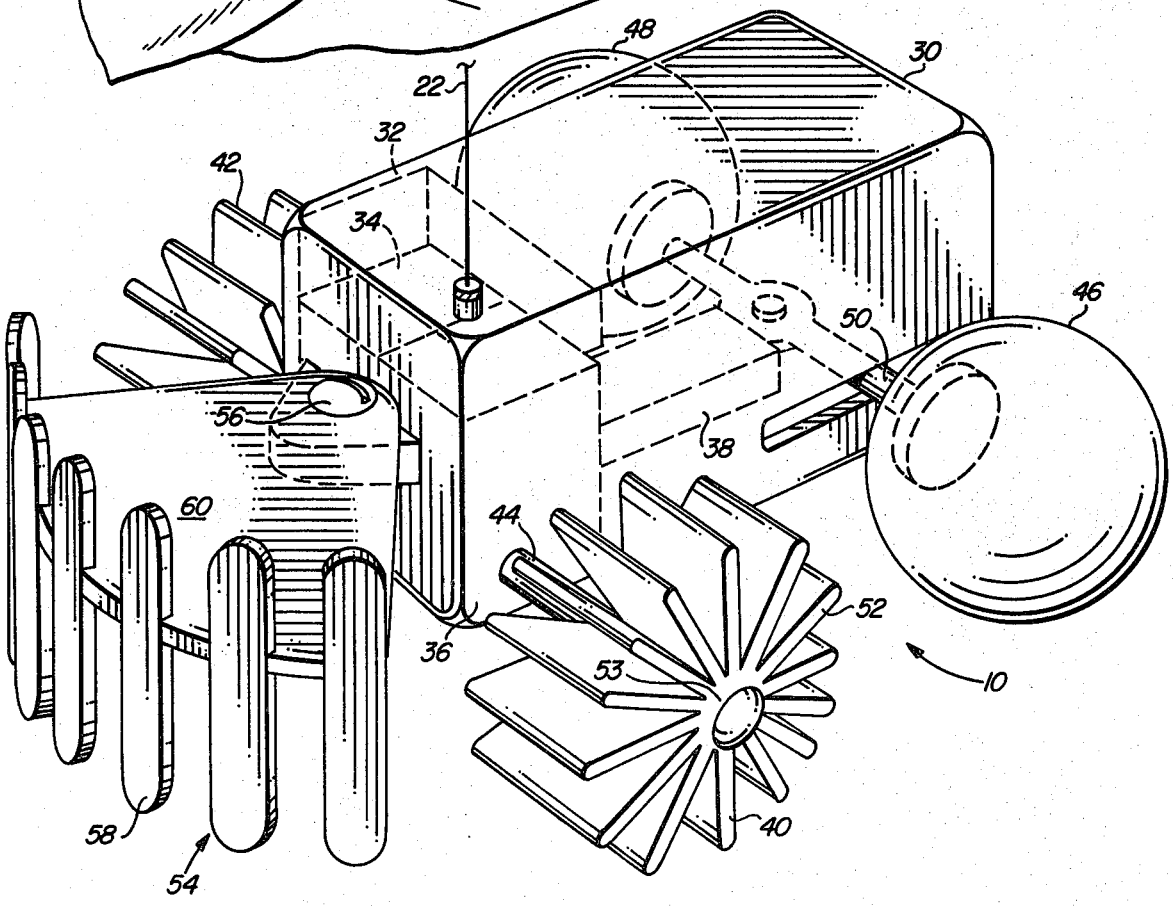
FIG. 2

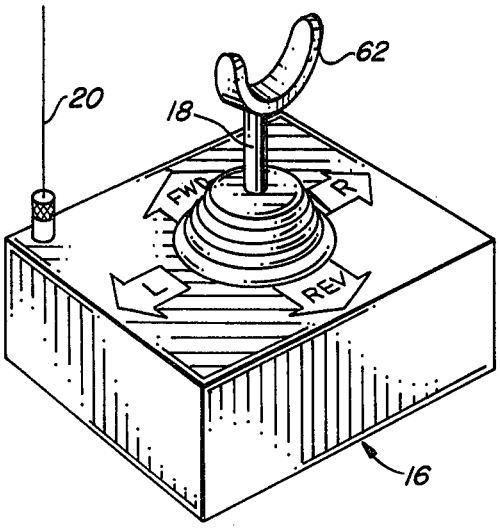
FIG. 3
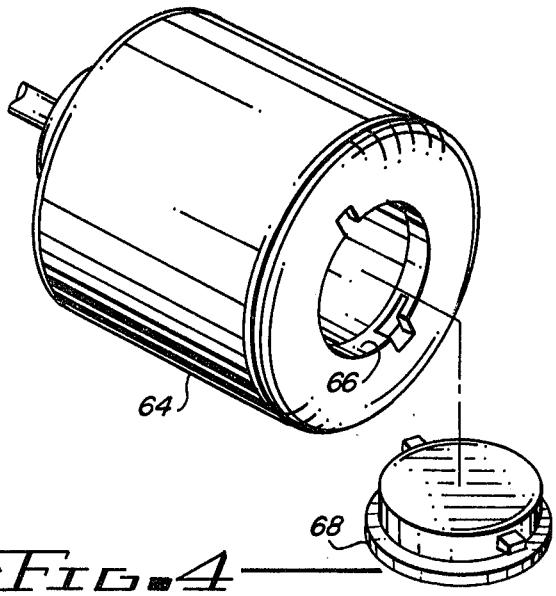
FIG. 4
FIG. 5
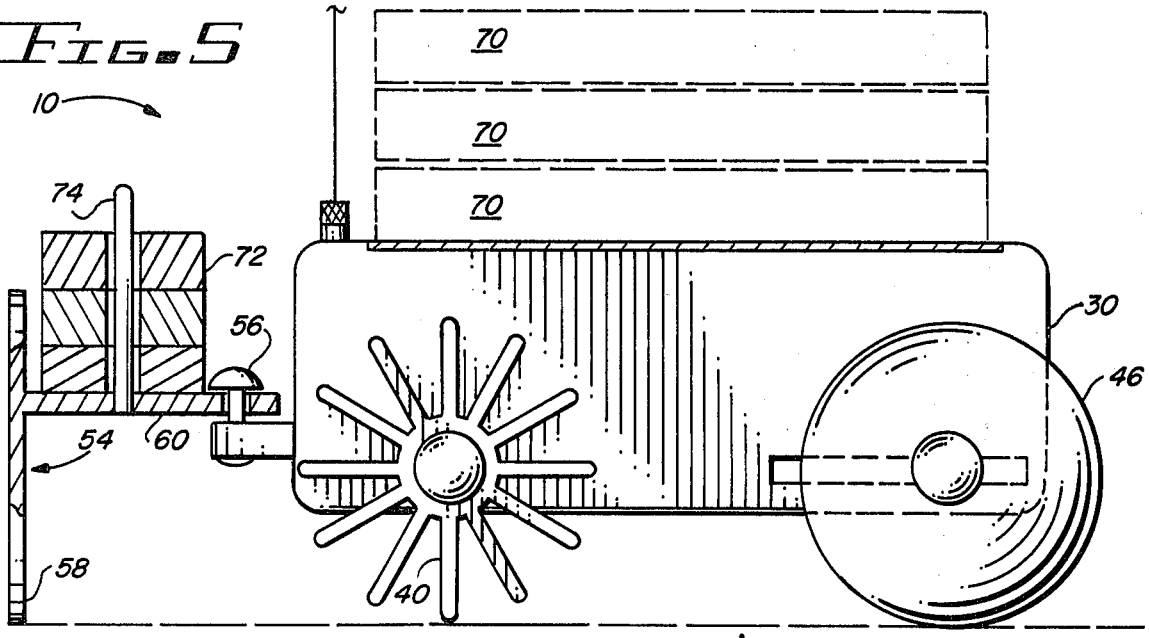
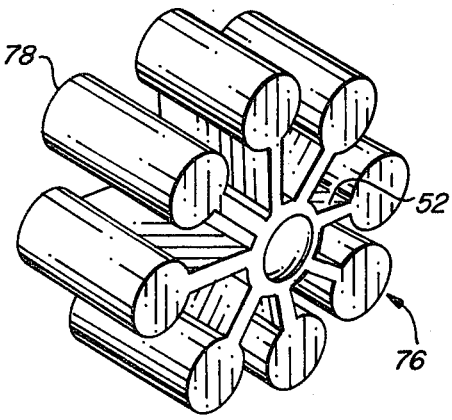
FIG. 6
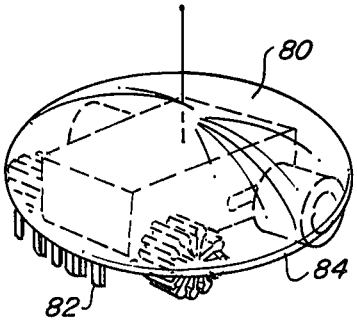
FIG. 7

REMOTELY CONTROLLED MASSAGING APPARATUS

The present invention relates to massaging apparatus and, more particularly, to self-propelled remotely contolled massaging units.

It is contended by the cognoscenti that a massage is most satisfying and pleasurable when done by a skilled masseur or masseuse. However, for most persons the services of a masseur or masseuse are not within financial reach on a regular basis. As substitutes for the skilled hands and technique of a professional, various devices have been developed which are usable by either unskilled third parties or by the person himself.

The following U.S. Letters Patent are representative of the state of the art of devices developed for imparting a massaging action. U.S. Pat. No. 2,628,611 describes a roller pin like device having an elastic roller to effect kneading and suction like pull of the subcutaneous tissues and longitudinally aligned brushes for frictional engagement with the skin. U.S. Pat. No. 2,944,543 is directed to a two roller handle supported massager having a vibrator attached to the handle for imparting impacting forces as the rollers are rolled across the tissues. U.S. Pat. No. 3,007,878 is directed to a motor driven massage apparatus wherein the driven element rotates about an axis perpendicular to the surface being massaged to pass massaging elements thereacross. U.S. Pat. No. 3,385,290 is directed to a handheld device having a motor for rotatably driving a first massaging element contemporaneous with a trailing rotating second massaging element. U.S. Pat. No. 4,157,712 is directed to a hand operated device having rotatable shaft mounted elements of nonradially constant perimeters to provide uneven pressure upon the surface being massaged as the unit is passed thereacross.

The devices described above generally and preferably require the services of a third party to operate them, particularly upon areas generally inaccessible to the person receiving the massage. Accordingly, various non operator actuated devices have been developed. In example, U.S. Pat. No. 3,078,843 is directed to a device for cyclicly and reciprocally passing a massaging element along a predetermined path upon actuation of the device. U.S. Pat. No. 3,875,604 describes a water pressure operated roller device particularly usable in a shower cabinet to effect vertical movement of a roller, which roller has a brushing and massaging effect upon a body part positioned thereagainst. U.S. Pat. No. 4,041,938 is directed to a motor driven device for passing a set of fingers reciprocatable horizontally and vertically across a user's back in simulation of a manual massage.

The non operator actuated massaging devices are relatively cumbersome and not particularly feasible for home use. Moreover, the complexity and physical size of the equipment renders it too expensive for home use and essentially relegates it to institutional therapeutic use. The substantially less expensive manually operated devices described above are more or less efficient and successful in performing their intended purpose but are totally useless without the aid of a third party to massage one's back or similar non readily accessible body surfaces.

The present invention is a compact small-sized self-propelled unit employing a remote control system for directing the speed and direction of the unit across the surface to be massaged. Accordingly, the unit can be operated by the user himself by injecting signals to a control unit which signals are representative of a desired direction and speed of travel of the massaging unit; or, the remote control unit may be operated by a third party. The massaging unit includes drive means, which upon rotation, impart a massaging action to a tissue depth relative to the number of removably mounted weights placed upon the unit. A pleasing and satisfying scratching action may be effected by detachably attaching a trailing rake-like member.

It is therefore a primary object of the present invention to provide a remotely controlled massaging unit fully controllable by the user.

Another object of the present invention is to provide a massaging unit operable upon any horizontal or near horizontal body surface.

Yet another object of the present invention is to provide a self propelled remotely controlled massaging unit which can provide a variable degree of massaging force.

Still another object of the present invention is to provide a user controlled and operated massaging unit for stimulating muscle tone, skin tone and flow of blood through capillary vessles.

A further object of the present invention is to provide a self contained massaging unit operable by a remote control unit physically independent of the massaging unit and fully controllable by the user.

A yet further object of the present invention is to provide a relatively inexpensive massaging unit which is self propelled and remotely controllable.

A still further object of the present invention is to provide drive elements of various interchangeable configurations for a massaging unit to vary the effectiveness and depth of massage imparted.

These and other objects will become apparent to those skilled in the art as the description of the present invention proceeds.

The present invention will be described with greater specificity and clarity with respect to the following drawings, in which:

FIG. 1 illustrates use of the massaging unit by a user;

FIG. 2 is an isometric view illustrating various components of the massaging unit;

FIG. 3 is an isometric view illustrating a configuration of the control unit;

FIG. 4 is a partial view illustrating certain features of a driving member;

FIG. 5 is a side view detachably attached weights for the massaging unit;

FIG. 6 depicts a variant of a driving element; and

FIG. 7 illustrates a variant of the body of the massaging unit supporting the various operative elements.

Referring to FIG. 1, there is shown a self propelled vehicular unit 10 traversing back 12 of a user 14. The unit is controlled, with respect to speed and direction, by a remotely located manually operated control unit 16. A control signal for the vehicular unit is generated by movement of a control stick 18 left or right for directional control and/or fore and aft for speed control. The signals generated by movement of the control stick are converted into radio frequencies and transmitted from an attached antenna 20. The transmitted signals are picked up by antenna 22 on vehicular unit 10 and converted by a receiver within the vehicular unit into control signals. The control signals actuate several mechanisms operatively engaging motive means for the vehicular unit and steering mechanisms. Thereby, the control unit is capable of regulating the speed of the vehicular unit forwardly or backwardly and left or right. It therefore becomes apparent that user 14 can control the path and speed of vehicular unit 10 transversing his back 12.

The operative apparatus of vehicular unit 11 will be described with primary reference to FIG. 2. The vehicular unit includes a body 30 for housing and protecting the various operative elements. These elements include a radio receiver 32, servo mechanisms 34, motive means 36 and steering mechanism 38. Antenna 22 may extend upwardly from the top of body 30, as illustrated. Drive members 40 and 42 are attached to an axle 44, which axle is rotatably driven by motive means 36. Steering elements 46 and 48 are operatively supported upon a pivotally mounted axle 50, which axle is operatively engaged with steering mechanism 38. It is to be understood that more sophisticated motive means, steering means and suspension system may be employed to achieve better tracking.

Drive members 40 and 42 provide two complementary functions: to propel the vehicle forwardly or backwardly and to knead or massage the body tissue over which the vehicular unit is traversing. To achieve both these goals, it is preferable that each drive member have a limited surface area in contact with the body tissue in order to exert relatively high pressure (pounds per square inch) thereupon to effect a kneading action in simulation of a manual massage and sufficient friction must be developed between the drive members and the traversed tissue to effect movement of the vehicular unit. A configuration (impeller-like) which satisfies both these goals is illustrated in FIG. 2. In this configuration, each body member includes a plurality of splines or radially extending plates 52 of somewhat stiff but still flexible material extending from a hub 53.

Steering elements 46 and 48 may have substantial latitude in configuration. Their primary function is that of altering the path of the vehicular unit in response to control signals generated by control unit 16. To achieve a change in direction, sufficient friction must be created between the steering elements and the underlying surface to create lateral loads and yet the steering elements must be configured to accommodate rolling movement across the uneven skin surface of the user. The sphere like elements depicted in FIG. 2 have been found a configuration which satisfies both these goals.

To relieve itching or otherwise simply provide the pleasure of gentle scratching of one's back, rake means 54 may be attached to vehicular unit 10. The point of attachment may be through a pivot means 56 and in a trailing configuration whereby gentle scratching of a previously massaged surface is effected upon movement of the vehicular unit. Rake means 54 may include a plurality of vertical bars 58 depending from a triangular plate 60, the apex of which is secured to the vehicular unit through pivot means 56. The contact point of bars 58 may be rounded as shown or more sharply configured, depending upon the intensity of scratching action desired.

FIG. 3 illustrates control unit 16 in further detail. Control stick 18 may include a yoke 62 for nesting a user's finger, as shown in FIG. 1. With such a configuration, minimum effort (one finger) is required by the user to direct the movement and speed of the vehicular unit. To obtain speed control in both the forward and reverse direction and steering in both the left and right direction, control stick 18 is configured to provide movement of two axis.

To effect hard kneading of a deep massage, the weight of vehicular unit 10 must be increased to achieve depression of the subcutaneous tissue. By employing hollow cylindrical devices 64, as shown in FIG. 4, for the drive members and/or the steering elements, the total weight of the vehicular unit can be increased by pouring lead shot therein. Access to the interior is through an aperture 66, which aperture may be sealed by a lockingly engageable cap 68.

Referring to FIG. 5 there is illustrated a further method of increasing the weight of vehicular unit 10. A plurality of plates 70 of lead or other dense material may be removably secured to the top surface of the vehicular unit. Accordingly, similar weights 72 may be mounted upon plate 60 of rake means 54 to increase the scratching force effected by bars 58. Weights 72 may be retained in place by penetrable engagement with a pin 74.

As discussed above, drive members 40 and 42 may be of any one of several configurations provided the two criteria of massage action and friction are achieved. A variant 76 of the configuration is shown in FIG. 6. Herein, each of plates 52 have attached to the terminal edge a cylinder 78. The additional surface area in contact with the underlying skin surface afforded by cylinders 78 is useful in permitting substantial weight to be added to vehicular unit 10 to achieve substantial depth in kneading force and yet not create so much pressure as to cause pain or injury.

A variant of the configuration of vehicular unit 10 is shown in FIG. 7. Herein, the operative elements may be enveloped within an inverted dish like shroud 80. Additionally, the bars of rake means 82 may extend downwardly from perimeter 84 of shroud 80.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A self-massaging apparatus for massaging one's back, said apparatus comprising in combination:

(a) a self-propelled vehicular unit;

(b) drive means for propelling said vehicular unit across one's back, said drive means including wheels having angularly displaced radially oriented flexible plates for imparting a varied pressure massaging action to the surface of the back traversed (c) selectively actuatable means for steering said vehicular unit right or left; and (d) a control unit for directing the forward/backward movement and left/right movement of said vehicular unit across one's back, said control unit including a remotely located transmitter for generating command signals relative to speed and direction of said vehicular unit and a receiver located at said vehicular unit for receiving the command signals and translating the command signals into signals for actuating said drive means and said steering means.

2. The apparatus as set forth in claim 1 wherein each said plate includes a terminal edge and a cylindrical member extending radially from each said terminal edge.

3. The apparatus as set forth in claim 1 wherein each said steering means includes spherically shaped wheels.

4. The apparatus as set forth in claim 1 including pivotally attachable means detachably attachable in a trailing configuration to said vehicular unit for scratching one's back along the path traversed by said vehicular unit.

5. The apparatus as set forth in claim 4 including means for selectively weighting said scratching means to increase the scratching force.

6. The apparatus as set forth in claim 1 including means for selectively weighting said vehicular unit to vary the depth and intensity of the massage.

* * * * *